US005797153A

United States Patent [19]

Amioka

[11] Patent Number: 5,797,153

[45] Date of Patent: Aug. 25, 1998

[54] ORTHOPEDIC BODY PILLOW

[76] Inventor: James Minoru Amioka, 57 Seth Sq., Plattsburgh, N.Y. 12901

[21] Appl. No.: 845,088

[22] Filed: Apr. 21, 1997

[51] Int. Cl.[6] ..... A47C 27/00

[52] U.S. Cl. ..... 5/632; 5/694; 5/727; 5/733; 5/734

[58] Field of Search ..... 5/630, 632, 633, 5/727, 730, 731, 733, 734, 735, 900.5, 903, 952, 594

[56] References Cited

U.S. PATENT DOCUMENTS

| | | | |
|---|---|---|---|
| 929,449 | 7/1909 | Klimowicz | 5/900.5 X |
| 2,795,802 | 6/1957 | Myers | 5/632 |
| 4,173,048 | 11/1979 | Varaney | 5/632 |
| 4,766,627 | 8/1988 | Landry | 5/903 X |
| 4,922,654 | 5/1990 | Thomas | 5/731 X |
| 5,107,558 | 4/1992 | Luck | 5/727 |
| 5,224,226 | 7/1993 | Groenewald | 5/632 X |

*Primary Examiner*—Michael F. Trettel

[57] ABSTRACT

A sound sleep system and provides a full body length orthopedic posture pillow that maintains correct spinal posture during supine, side lying, and prone sleep positions.

4 Claims, 2 Drawing Sheets

Fig. 1
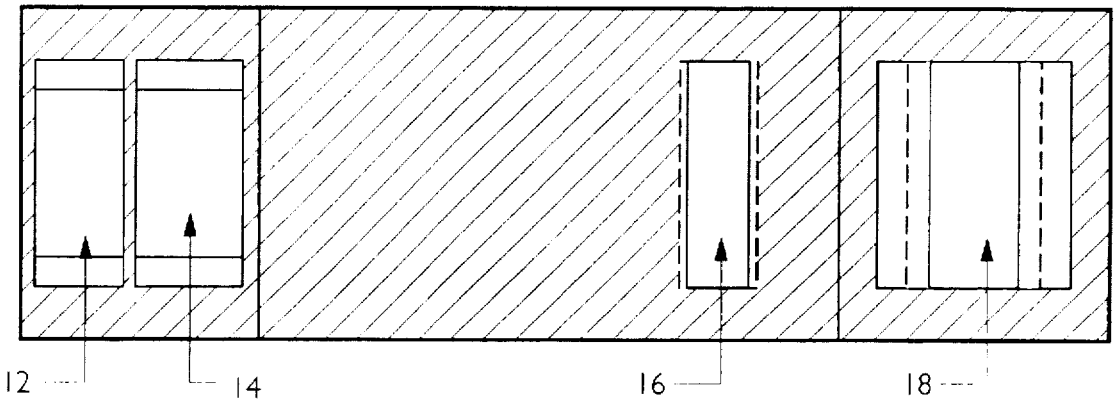
Fig.2
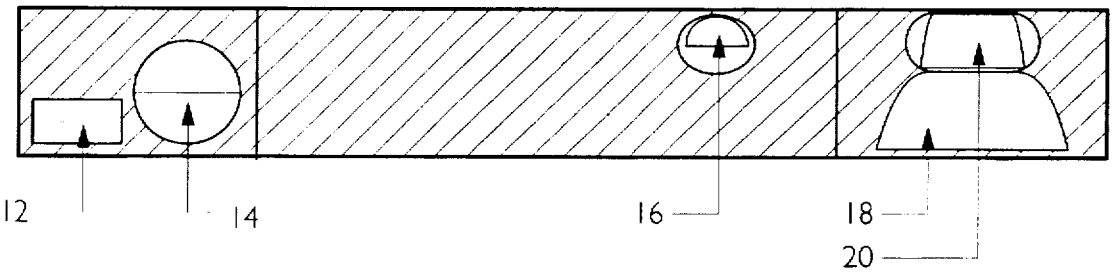
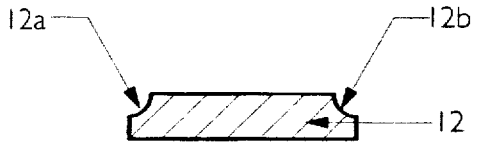
Fig.3
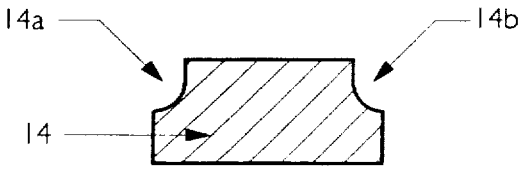
Fig.4

ORTHOPEDIC BODY PILLOW

BACKGROUND OF THE INVENTION

The present invention relates to a sound sleep system and particularly to a posture pillow for providing optimum support and comfort for the body in any sleeping posture including supine (back lying), side lying, and prone (stomach lying).

Most people spend 6 to 8 hours asleep per day such that it is important for the body to maintain a position that promotes ideal posture for the body. The key is to support the body in a manner that maintains correct spinal posture.

SUMMARY OF THE INVENTION

The present invention is directed to a sound sleep system and provides a full body length orthopedic posture pillow that maintains correct spinal posture during supine, side lying, and prone sleep positions.

The full body length posture pillow provides for support of skull, neck, lumbar and knees. The posture pillow is full body length essentially the same as that of a supporting mattress with which the posture pillow is normally used. The width of the posture pillow is less than the supporting mattress and is nominally one-half to three-quarters mattress width.

The posture pillow is fitted with a flat cushion for supporting the skull, a cervical roll for supporting the neck, a lumbar roll for supporting the low back, and a knee pillow for providing a pelvic tilting posture which reduces stress on the lower back.

The posture pillow is normally used on a mattress, that removably placed on the mattress. The pillow can easily be transferred to a lounge chair. The posture pillow may also be affixed to a chair and sold as a chair model.

OBJECTS OF THE INVENTION

An object of the invention is to provide a sound sleep pillow posture system.

Another object of the invention is to a posture pillow for promoting correct spinal posture while asleep in supine, side lying and prone positions.

Another object of the invention is to provide a full length posture pillow normally positioned atop a mattress and suitable for transfer to an easy chair for use in a sitting position.

An object of the invention is to provide a sound sleep pillow posture system including skull, neck, low back, and knee supports.

Other and further objects of the invention will become apparent with an understanding of the following detailed description of the invention or upon employment of the invention in practice.

A preferred embodiment of the invention has been chosen for purposes of detailed description and is shown in the accompanying drawing in which:

FIG. 1 is a plan view of the posture pillow according to the invention.

FIG. 2 is a side elevation view thereof.

FIG. 3 is a front elevation view of a flat cushion for supporting the skull.

FIG. 4 is a front elevation view of a cervical roll for supporting the neck.

DETAILED DESCRIPTION OF THE PREFERRED EMBODIMENT

Figure 5:
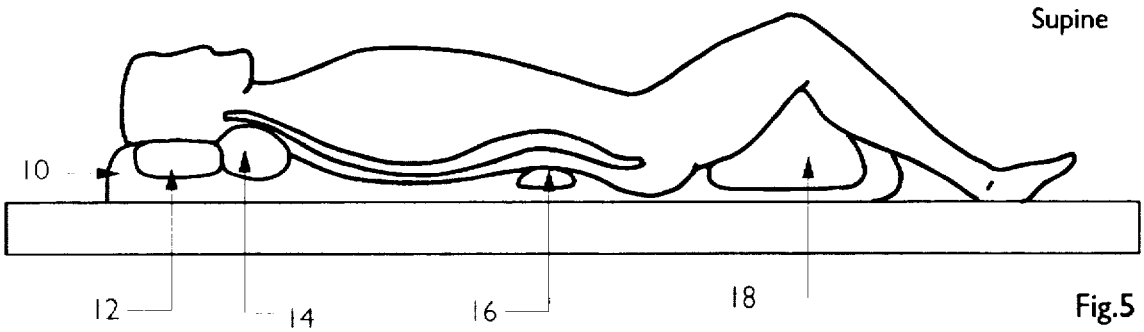
FIG. 5 is a side view of the posture pillow in a supine sleeping position.

Referring to the drawing, a sound sleep posture pillow system according to the invention comprises an elongate pillow 10 fitted with a flat cushion 12, a cervical roll 14, a lumbar roll insert 16, a knee pillow 18 and a knee extension 20. In an illustrative embodiment, the pillow is approximately 72 inches long and 22 inches wide. In a preferred use, the posture pillow is placed atop a standard mattress.

The flat cushion and cervical roll are of medium density and are embedded in the polyfill or down interior filling of the pillow. The down or polyfill areas are indicated by section lines in FIGS. 1 and 2. The flat cushion is preferably 15 inches long, 6 inches wide and 3 inches high. The cervical roll is preferably 15 inches long and 22 inches in diameter. As shown in FIGS. 3 and 4 the opposite top edges 12*a,b*; 14*a,b* of the flat cushion and cervical roll are relieved or cut away to support the head and neck in the semi-prone position shown in FIG. 7.

The lumbar roll is a removable insert in that some individuals may tolerate only a very small lumbar support or none at all. So the lumbar roll insert may vary in size from 15 inches long, 2 inches wide and 1 inch high to 15 inches long, 4 inches wide, and 2 inches high.

The knee position of the posture pillow includes a knee pillow embedded in the down or polyfill pillow and measuring approximately 15 inches long, 13 inches wide, and 5 inches high. A removable knee extension insert may be placed over the knee pillow and measures 15 inches long, 13 inches wide, and 5 inches high. Both the knee pillow and the knee extension are medium-firm density.

In use, the body weight will push the flat cushion, cervical roll, and lumbar cushions down and the cushions/roll will "float" in the polyfill or down providing gentle support.

In the supine position shown in FIG. 5, the cervical roll provides support to maintain the normal cervical lordosis, and the flat cushion provides support for the skull. The insertable lumbar roll provides gentle support to maintain the normal lumbar lordosis. The knee pillow provides support from 5 inches to 8 inches (with the insertable 3 inch extension) and allows a gentle pelvic tilting posture which reduces stress on the lower back.

Figure 6:
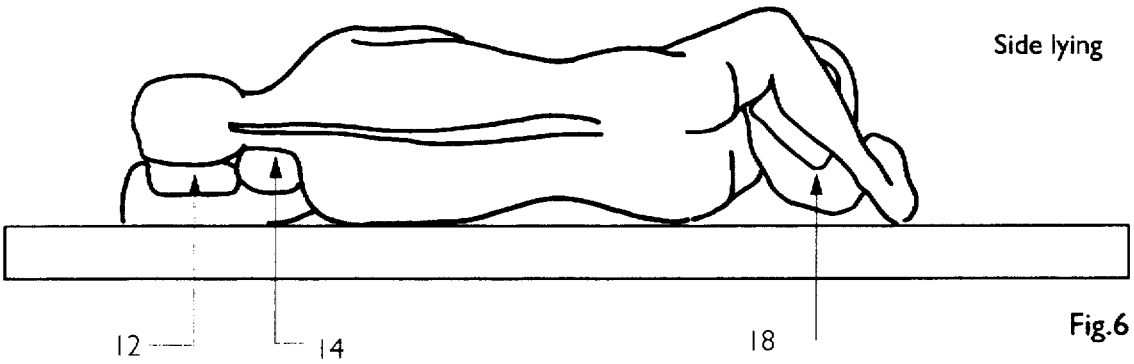
FIG. 6 is a side view of the posture pillow in a side lying sleeping position.

In the side lying position of FIG. 6, the cervical roll and flat cushion provide proper neck and skull support, the center portion becomes a pillow, while the knee pillow can be positioned between the knees to reduce some pressure on the hips.

Figure 7:
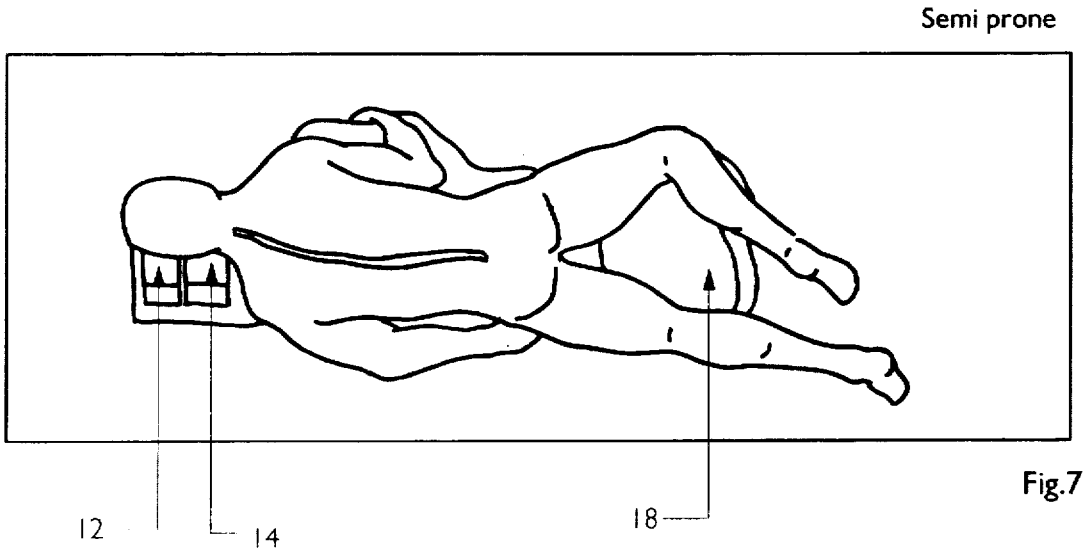
FIG. 7 is a top view of the posture pillow in a semi-prone sleeping position.

While a prone sleeping position is not recommended, the body pillow used in the semi-prone position shown in FIG. 7 can reduce some of the stresses induced in this position. The center portion of the body pillow is positioned against the torso (sleeping at an angle of 40 degrees or less), giving the feeling of sleeping on the stomach (i.e., semi-prone position). The knee pillow is positioned between the knees and further prevents the person from reaching their stomach. The cervical roll and flat cushion have cutouts 12*a,b*; 14*a,b* on each end to provide support to a persons head and neck while maintaining the correct anterior-to-posterior position of the neck and skull in relation to the rest of the spine, that is to say, no head rotation with respect to the spine.

The dimensions given above are for an adult configuration of the posture pillow and its cushions, rolls and inserts. Smaller scaled body pillows can be produced for most children.

Various changes may be made to the structure embodying the principles of the invention. The foregoing embodiments are set forth in an illustrative and not in a limiting sense. The scope of the invention is defined by the claims appended hereto.

I claim:

1. A posture pillow for sound sleep comprising an body pillow generally conforming to a reclining person's body length and width, the body pillow having a filler material therein, a flat cushion for supporting the skull and a cervical roll for supporting the neck, the flat cushion and the cervical roll both positioned within the filler material of the body pillow, a lumbar surface cavity in the body pillow for receiving a lumbar roll, a knee pillow positioned within the filler material of the body pillow, and a knee surface cavity in the pillow for receiving a knee extension.

2. A posture pillow as defined in claim 1 which further includes a lumbar roll in the lumbar cavity, and a knee extension in the knee cavity.

3. A posture pillow as defined in claim 1 in which the corner edges of the flat cushion and the cervical roll are cut away to provide support for a persons head and neck in a semi-prone sleeping position.

4. A posture pillow as defined in claim 2 in which the the flat cushion, and cervical roll lumbar roll are of medium density, and the knee extension and the knee pillow are medium-firm density.

* * * * *

UNITED STATES PATENT AND TRADEMARK OFFICE

CERTIFICATE OF CORRECTION

PATENT NO. : 5,797,153

DATED : August 25, 1998

INVENTOR(S) : Amioka

It is certified that error appears in the above-identified patent and that said Letters Patent is hereby corrected as shown below:

Column 2, line 22, replace "diameter" with –circumference–.

Signed and Sealed this

Sixteenth Day of February, 1999

*Attest:*

*Attesting Officer*

*Acting Commissioner of Patents and Trademarks*